US007455381B2

(12) United States Patent
Koike et al.

(10) Patent No.: US 7,455,381 B2
(45) Date of Patent: Nov. 25, 2008

(54) INKJET RECORDING APPARATUS AND INK MANAGEMENT METHOD FOR AN INKJET RECORDING APPARATUS

(75) Inventors: Toshiaki Koike, Suwa (JP); Tomoyuki Oi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 207 days.

(21) Appl. No.: 11/324,881

(22) Filed: Jan. 4, 2006

(65) Prior Publication Data

US 2006/0158469 A1 Jul. 20, 2006

(30) Foreign Application Priority Data

Jan. 14, 2005 (JP) ..... 2005-008199

(51) Int. Cl.
*B41J 29/393* (2006.01)

(52) U.S. Cl. ..... 347/19; 347/7; 347/86

(58) Field of Classification Search ..... 347/6, 347/7, 19, 23, 86
See application file for complete search history.

(56) References Cited

U.S. PATENT DOCUMENTS 5,666,146 A 9/1997 Mochizuki et al.
6,264,314 B1 7/2001 Mochizuki et al.
7,077,512 B2 * 7/2006 Kobayashi et al. ..... 347/85
2002/0093555 A1 7/2002 Kobayashi et al.
2005/0110823 A1 5/2005 Kobayashi et al.
2005/0174403 A1 * 8/2005 Watanabe et al. ..... 347/86

FOREIGN PATENT DOCUMENTS

JP 5-16378 1/1993
JP 2002-200749 7/2002

* cited by examiner

*Primary Examiner*—Matthew Luu
*Assistant Examiner*—Henok Legesse
(74) *Attorney, Agent, or Firm*—Rosalio Haro

(57) ABSTRACT

An inkjet recording apparatus and ink management method determine how much ink leaks when an ink cartridge is replaced, prompts the user to replace the ink sponge with another sponge of the necessary thickness and ink absorption capacity, and thus prevents ink leakage from soiling the cartridge holder. The amount of ink leakage is detected based on the time from when the ink cover 8 opens until the ink cartridge 12 is removed from the cartridge holder 16, and manages the ink absorbed by the ink absorbing material 20 accordingly.

2 Claims, 6 Drawing Sheets

INKJET RECORDING APPARATUS AND INK MANAGEMENT METHOD FOR AN INKJET RECORDING APPARATUS

RELATED APPLICATIONS

Japanese patent application No. 2005-008199, is hereby incorporated by reference in its entirety.

BACKGROUND OF THE INVENTION

1. Field of the Invention

The present invention relates to an inkjet recording apparatus which enables knowing how much ink remains in the ink tubes when the ink cover that covers the ink cartridge is open, and to an ink management method for this inkjet recording apparatus.

2. Description of the Related Art

Inkjet recording apparatuses, referred to herein as simply inkjet printers, are relatively quiet when printing, can print very fine dots at a very high density, and have thus found many uses in color printing and other applications. Inkjet printers of this type typically have an inkjet recording (print) head that is mounted on a carriage and moves widthwise to the paper or other recording medium, and a paper transportation assembly that conveys the recording medium relative to the print head in a direction perpendicular to the direction of print head movement. Ink is discharged from the print head based on print data to print on the paper or other recording medium.

If the print head mounted on the carriage has elements for discharging black, yellow, cyan, and magenta ink, the printer is not limited to printing text using black ink and can be used for full-color printing by controlling the discharge ratio of each color of ink. See, for example, Japanese Unexamined Patent Appl. Pub. 2002-200749.

The mechanism for installing and removing an ink cartridge to the ink cartridge holder in this type of printer generally has an ink supply nozzle disposed to the ink cartridge mounting portion of the cartridge holder. An ink suction opening formed in the ink cartridge is then inserted over this ink supply nozzle and the ink cartridge is slid into place on the cartridge holder.

This mechanism for installing and removing the ink cartridge assumes using an ink cartridge having a flexible ink sack that is filled with ink, an ink suction opening formed in the ink sack for drawing ink from the sack, and a rectangular rigid plastic case in which the ink sack is held. See, for example, Japanese Unexamined Patent Appl. Pub. H05-16378.

The ink suction opening formed in the ink sack is exposed from the front of the rigid plastic case. The ink supply nozzle rendered on the ink cartridge mounting portion of the cartridge holder of the inkjet printer can therefore be inserted to this ink suction opening so that ink can be drawn from the ink sack.

When ink cartridges are repeatedly installed and removed from the cartridge holder of the ink cartridge installation mechanism in this conventional inkjet recording apparatus, the portion of the ink supply nozzle that is inserted to the ink suction opening of the ink sack gradually becomes fatigued and may become deformed, resulting in a gap between the nozzle and the ink sack opening. Ink inside the ink cartridge and in the ink tube communicating the ink cartridge with the print head can then leak to the outside from this gap.

Furthermore, when an ink cartridge is loaded in the cartridge holder, opening the ink cover of the cartridge holder to remove the ink cartridge relieves the pressure applied to the ink cartridge by the ink pressure pump.

A problem with this arrangement is that while the pressure decreases gradually, the pressure is still high for the first few seconds after the cover opens, and ink remaining in the ink cartridge and in the tubes communicating the ink cartridge with the print head leaks outside from the connection between the ink supply nozzle and the ink suction opening in the ink sack.

A sponge or other ink absorbing material is therefore used to absorb the ink leaking from this cartridge connection and prevent ink from pooling in or adhering to the cartridge holder. As a result, the ink cartridge can also be replaced without getting your hands dirty.

A problem with the foregoing prior art is that the size of the ink absorbing material disposed in the conventional cartridge holder is limited due to design limitations, for example, and the ink absorption capacity is therefore small. As a result, if the volume of the leaked ink exceeds the ink absorption capacity of the ink absorbing material, the ink will overflow into the cartridge holder, thus soiling the inside of the cartridge holder. The user's hands thus also get dirty when replacing the ink cartridge.

The present invention solves this problem by providing an inkjet recording apparatus and an ink management method for the same that prevents ink from soiling the cartridge holder by first determining the remaining ink volume and prompting the user to replace the ink absorbing material with an ink absorbing material having sufficient thickness and ink absorption capacity.

SUMMARY OF THE INVENTION

An inkjet recording apparatus according to a first aspect of the invention has a cartridge holder for removably installing an ink cartridge, and a recording head installed to the cartridge holder for discharging ink drops based on printing control data to form an image on a recording medium using ink supplied from a pressurized ink cartridge. When an ink cover is opened and the ink pressure is thus relieved, ink that leaks when the ink cartridge is removed from the cartridge holder is absorbed by an ink absorbing material disposed to the cartridge holder, and the time from when the ink cover opens until the ink cartridge is removed from the cartridge holder is measured to detect how much ink leaks.

An inkjet recording apparatus according to a second aspect of the invention has a cartridge holder for removably installing an ink cartridge, and a recording head installed to the cartridge holder for discharging ink drops based on printing control data to form an image on a recording medium using ink supplied from a pressurized ink cartridge. Ink pressure is relieved when an ink cover is opened, and ink that leaks when the ink cartridge is removed from the cartridge holder is absorbed by an ink absorbing material disposed to the cartridge holder. In this aspect of the invention the amount of ink leakage is detected based on the change in pressure in the ink path inside the ink cartridge or cartridge holder from the time when the ink cover opens until the time when the ink cartridge is removed from the cartridge holder.

Another aspect of the invention is an ink management method for an inkjet recording apparatus having an ink cartridge removably installed in a cartridge holder, a recording head for discharging ink drops based on printing control data to form an image on a recording medium using ink supplied from a pressurized ink cartridge, and an ink absorbing material disposed to the cartridge holder for absorbing ink that leaks when the ink cartridge is removed from the cartridge holder after an ink cover is opened and the ink pressure is relieved. The ink absorbed by the ink absorbing material is managed by detecting how much ink leaks based on the time from when the ink cover opens until the ink cartridge is removed from the cartridge holder.

In an ink management method according to another aspect of the invention for an inkjet recording apparatus having an ink cartridge removably installed in a cartridge holder, a recording head for discharging ink drops based on printing control data to form an image on a recording medium using ink supplied from a pressurized ink cartridge, and an ink absorbing material disposed to the cartridge holder for absorbing ink that leaks when the ink cartridge is removed from the cartridge holder after an ink cover is opened and the ink pressure is relieved, the amount of ink leakage is detected based on pressure change in the ink path inside the ink cartridge or cartridge holder from when the ink cover opens until the ink cartridge is removed from the cartridge holder.

EFFECT OF THE INVENTION

An inkjet recording apparatus and an ink management method for an inkjet recording apparatus according to the present invention determine the amount of ink leakage based on the time from when the ink cover is opened until the ink cartridge is removed from the cartridge holder, or the change in pressure inside the ink cartridge or cartridge holder, and prompts the operator to install an ink absorbing material appropriate to the result of this measurement. This avoids using an ink absorbing member beyond the ink absorption capacity of the ink absorbent, and thus eliminates dirtying the user's hands when replacing the cartridge holder or ink cartridge.

Furthermore, ink leakage can be accurately measured as a result of determining the amount of ink leakage in terms of time or pressure. This ink leakage information can also be separately managed for each ink cartridge when individual ink cartridges are removed from the cartridge holder.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

A preferred embodiment of an inkjet recording apparatus according to the present invention is described below with reference to the accompanying figures.

Figure 1:
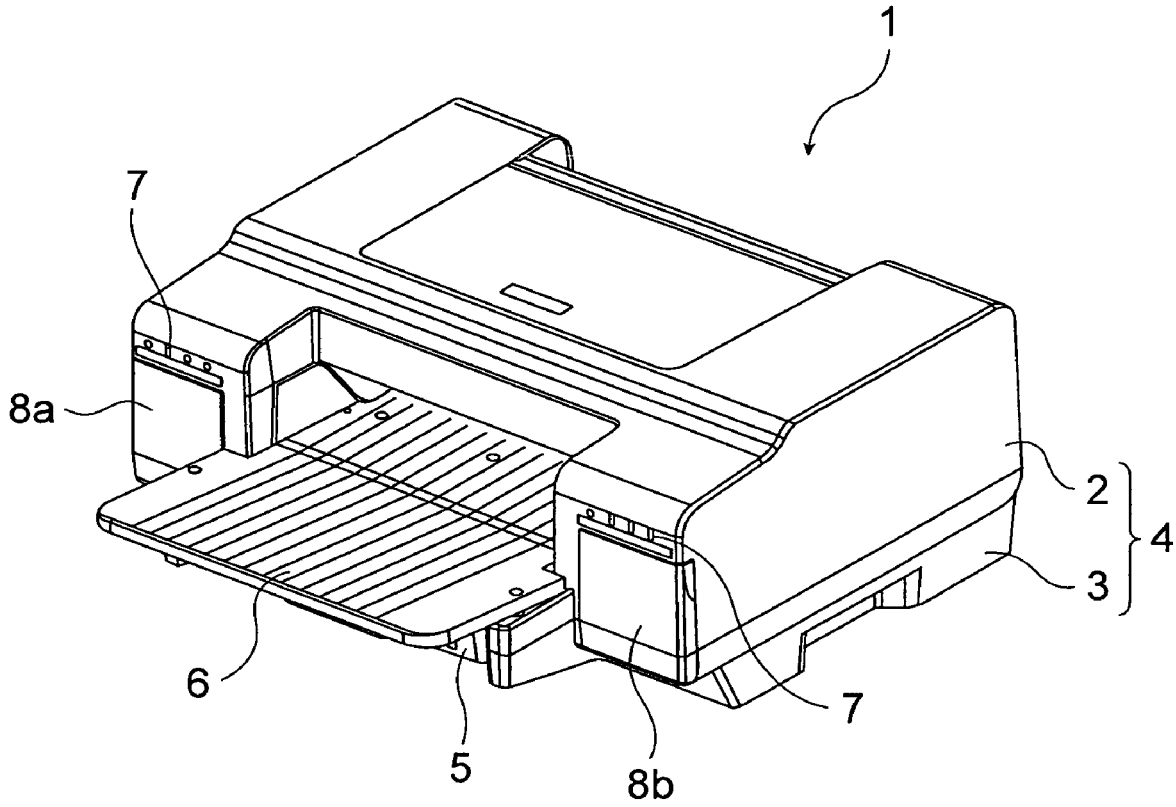
FIG. 1 is an oblique view of an inkjet recording apparatus according to a preferred embodiment of the present invention.
Figure 2:
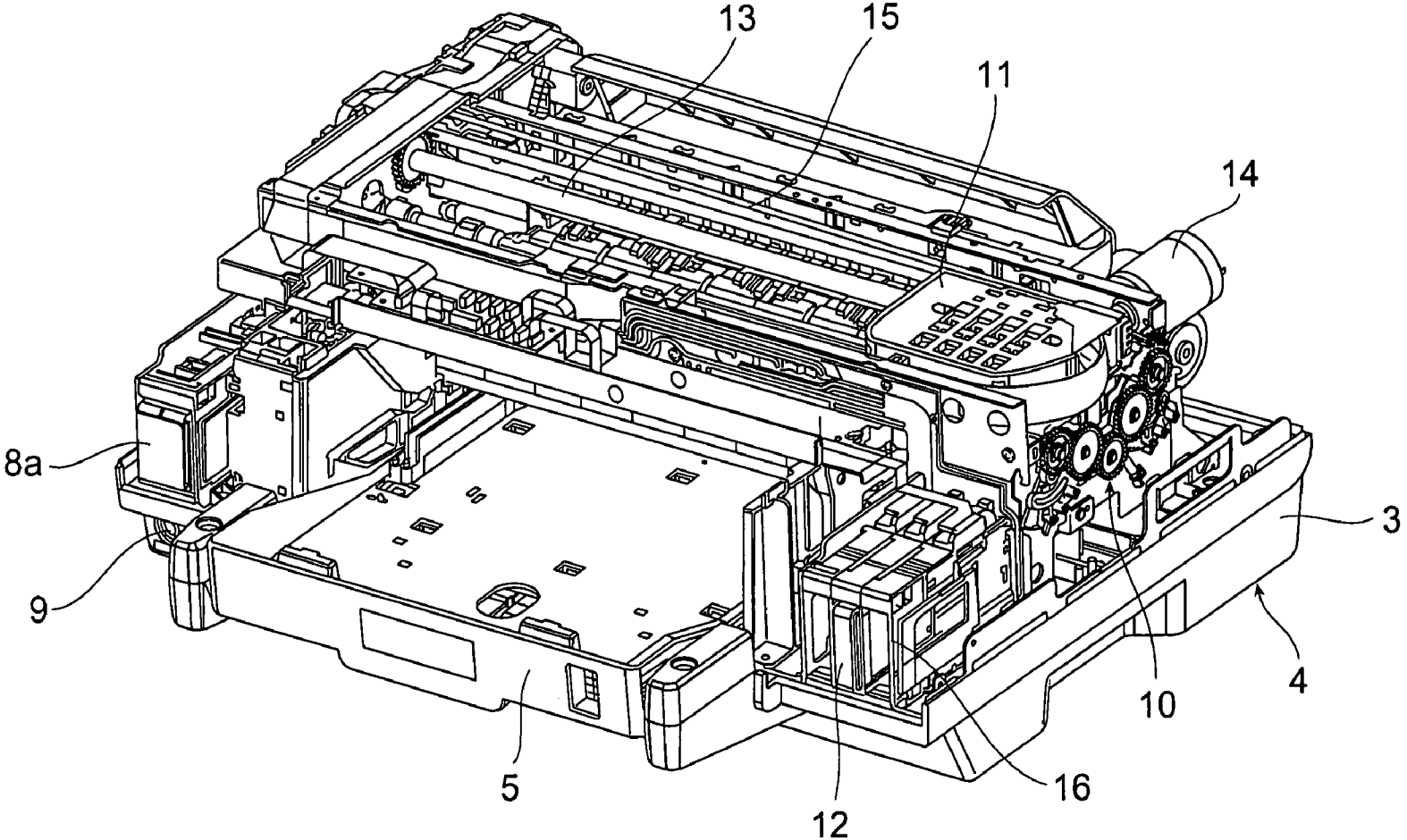
FIG. 2 shows the inkjet recording apparatus shown in FIG. 1 with the paper discharge tray and top case removed.
Figure 3:
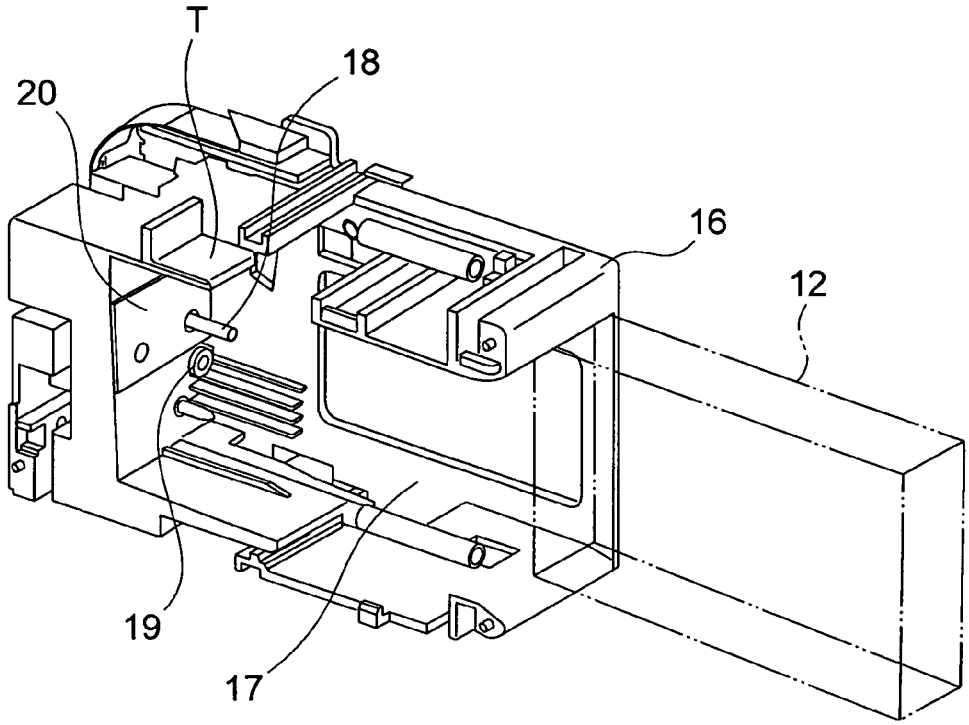
FIG. 3 is an oblique view showing the internal arrangement of the cartridge holder in the present invention.
Figure 4:
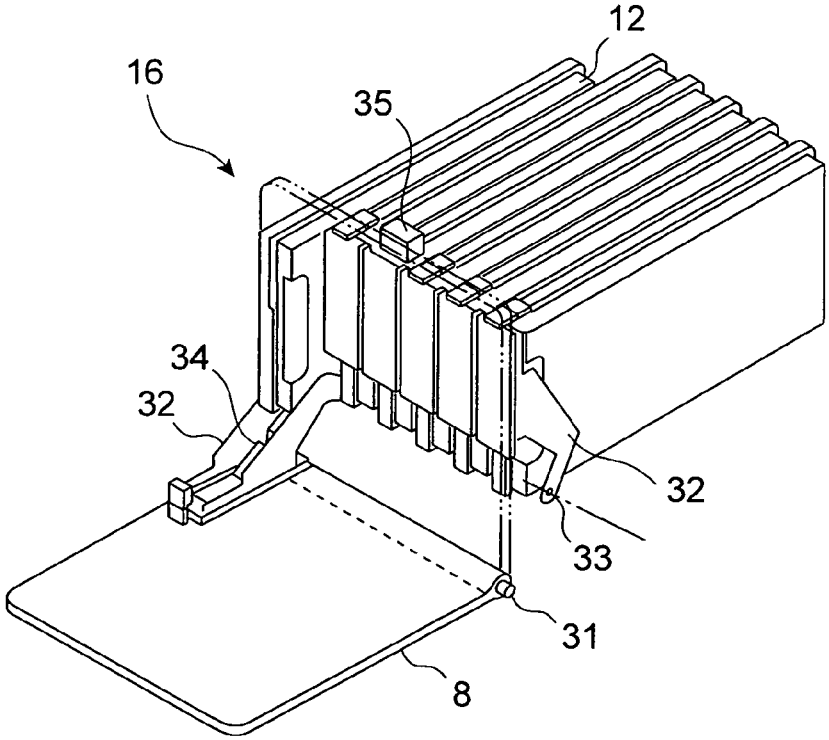
FIG. 4 is an oblique view showing the front of the cartridge holder in the present invention.
Figure 5:
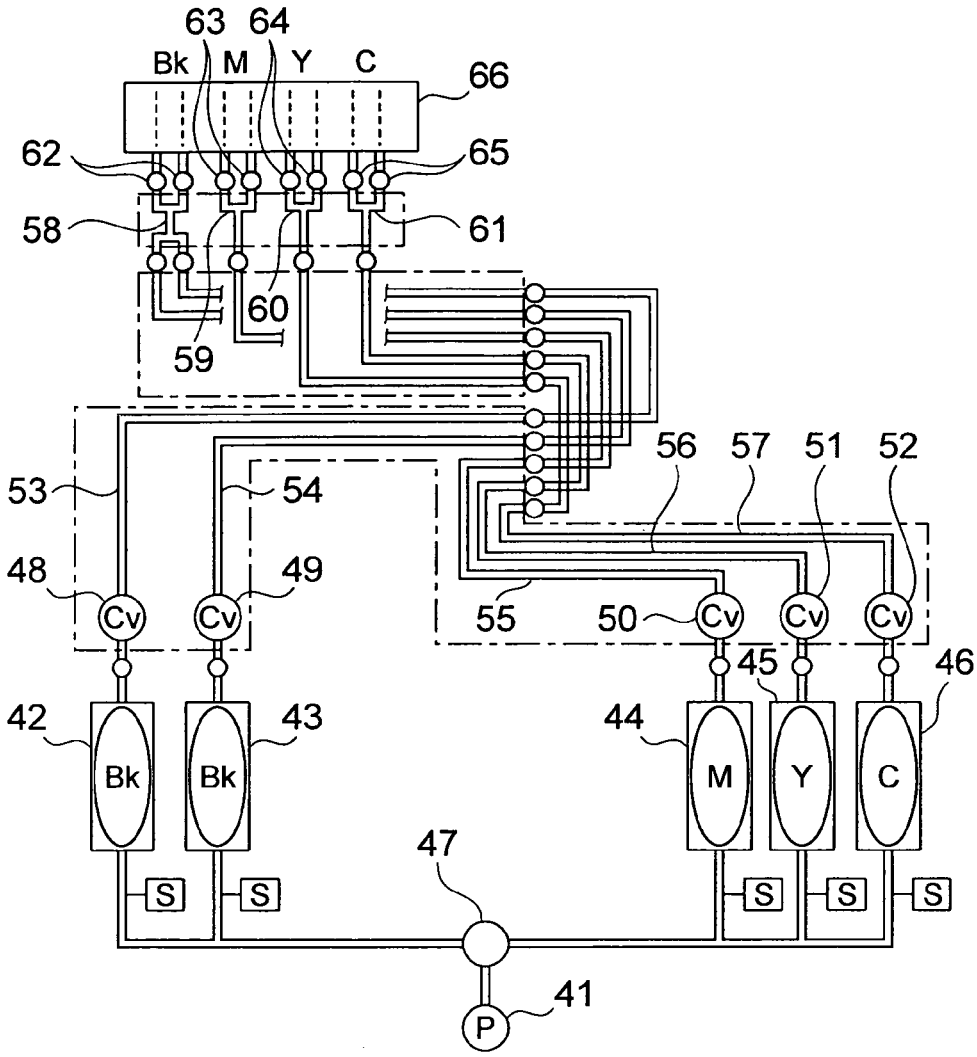
FIG. 5 is a schematic diagram showing the ink paths for ink flow from the ink cartridge to the print head in the present invention.
Figure 6:
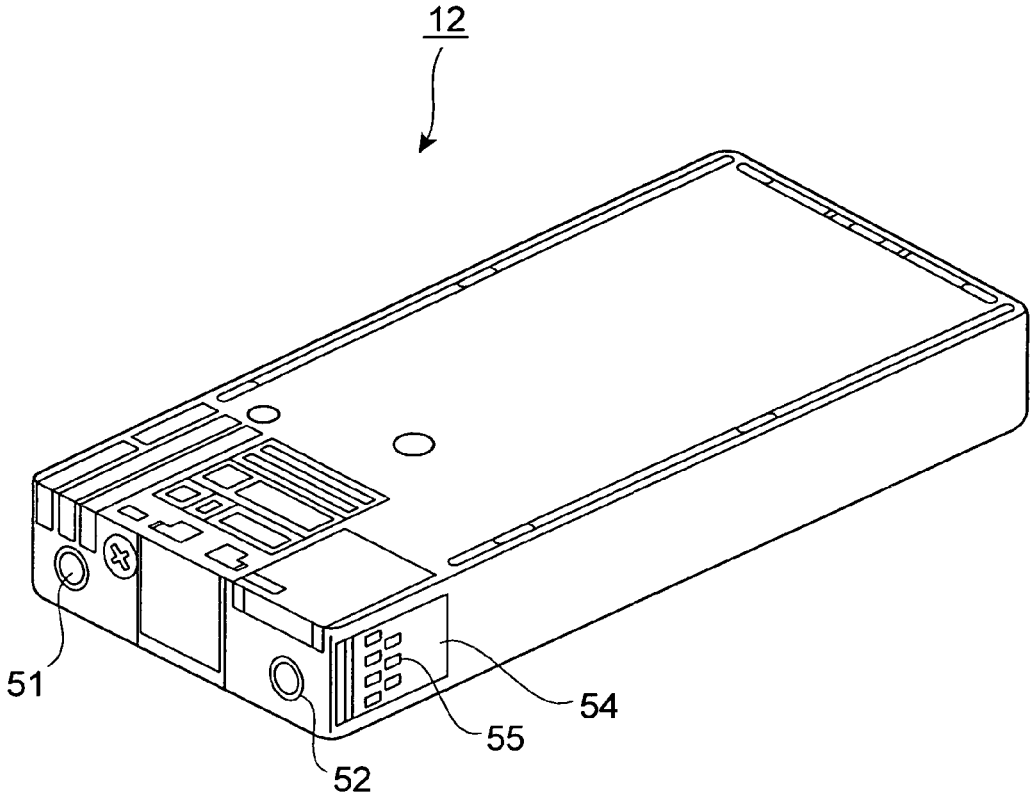
FIG. 6 is an oblique overview of an ink cartridge in the present invention.
Figure 7:
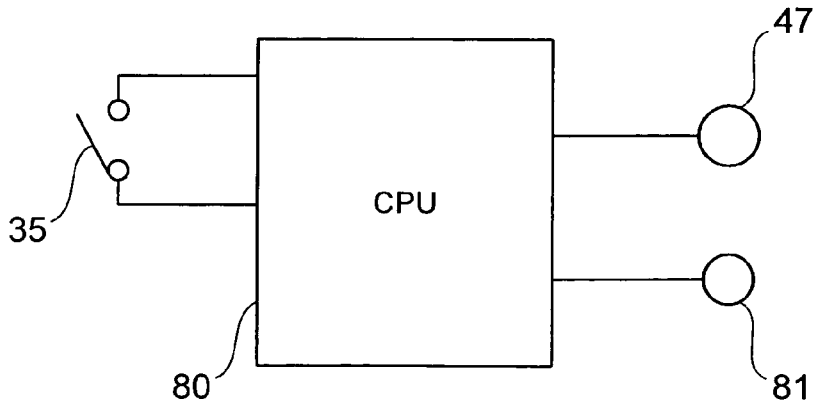
FIG. 7 is a block diagram of the ink volume calculating device in the present invention.
Figure 8:
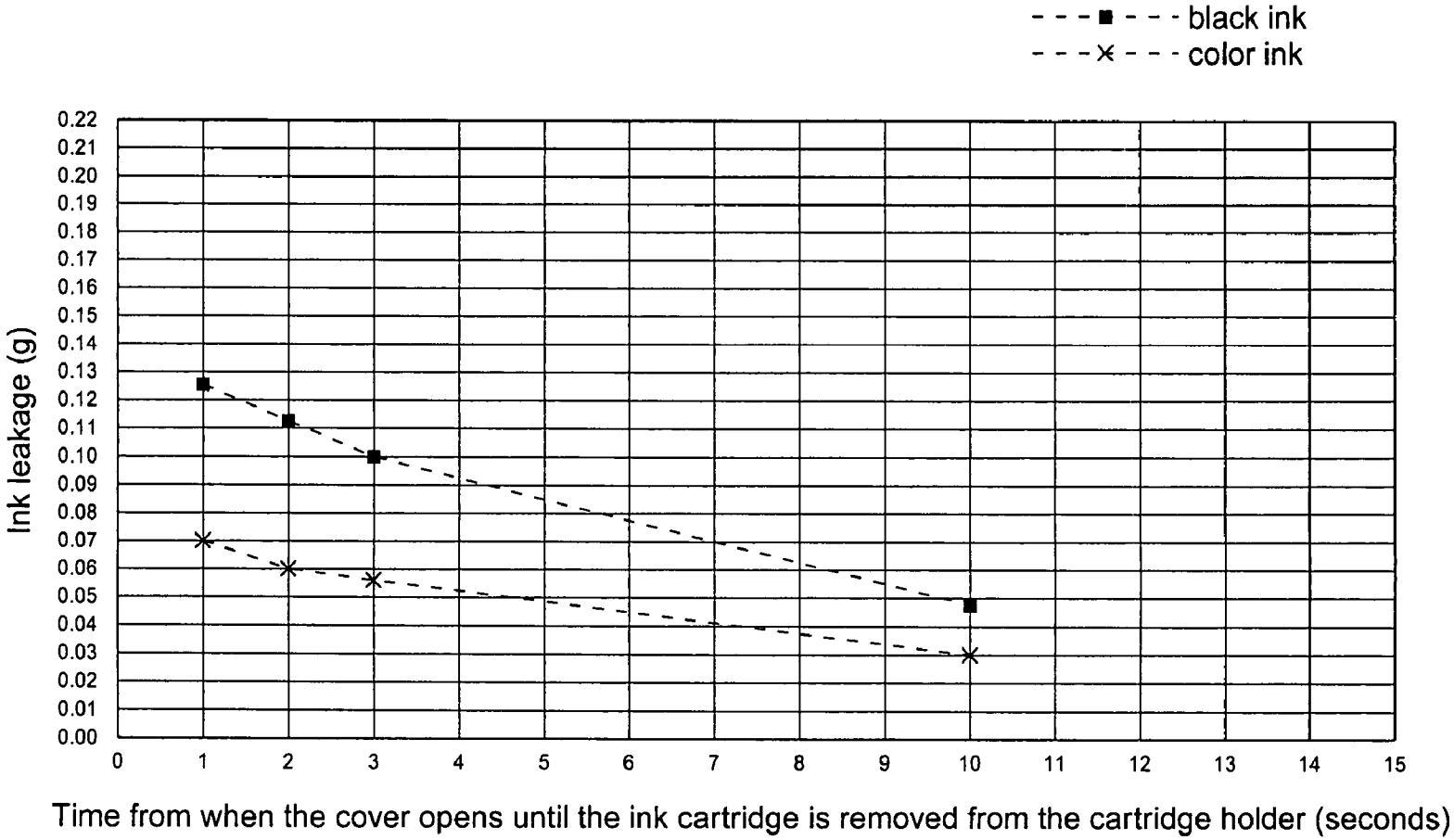
FIG. 8 is a graph showing ink leakage over time when the ink cover is opened.

FIG. 1 is an oblique view of an inkjet recording apparatus according to a preferred embodiment of the present invention. FIG. 2 shows the inkjet recording apparatus shown in FIG. 1 in detail. FIG. 3 is an oblique view describing the relationship between the cartridge holder shown in FIG. 1 and the ink cartridge. FIG. 4 is an oblique view showing the ink cover opening/closing unit of the cartridge holder shown in FIG. 1. FIG. 5 is a schematic diagram showing the ink paths for ink flow from the ink cartridge to the print head. FIG. 6 is an oblique overview of an ink cartridge. FIG. 7 is a block diagram of the ink volume calculating device, and FIG. 8 is a graph showing ink leakage over time.

An inkjet printer 1 according to this embodiment of the invention is a front-loading business printer that also discharges the paper to the front of the printer. As shown in FIG. 1 this inkjet printer 1 has a printer case 4 composed of a top case 2 and a bottom case 3. A box-like paper cassette 5 that holds cut-sheet paper can be freely installed and removed at the front middle part of the printer case 4.

An exit tray 6 that covers the top open part of the paper cassette 5 and receives the discharged paper after printing is completed is also disposed above the paper cassette 5. Display units 7 composed of LEDs, for example, for indicating the operating status of the printer are rendered at the front of the printer case 4 on both sides of the paper cassette 5.

A black ink cover 8*a* and a color ink cover 8*b* are disposed on the left and right sides, respectively, of the printer case 4 below the corresponding display units 7. The black ink cover 8*a* covers the front of a black ink storage compartment for storing a black ink tank, and the color ink cover 8*b* covers the front of a color ink compartment for storing a plurality of color ink tanks.

The black ink cover 8*a* and color ink cover 8*b* are attached to open and close freely, and opening the ink covers 8*a*, 8*b* enables access to the ink cartridges, which can be freely installed to and removed from the ink cartridge compartment inside the ink covers.

As shown in FIG. 2, a pushbutton type power switch 9 for turning the power of the inkjet printer 1 on and off is disposed below the black ink cover 8*a*. Turning the power switch 9 on supplies power to the transportation mechanism 10 as well as various sensors, control units, the process gap adjustment mechanism, printing mechanism, and other mechanisms not shown in detail, and thus enables the inkjet printer 1 to operate.

Also rendered inside the printer case 4 as shown in FIG. 2 are a transportation mechanism 10, carriage 11, print head, and ink cartridge 12. The pickup roller of the paper supply mechanism described below delivers the recording paper one sheet at a time from the paper cassette 5, and the transportation mechanism 10 conveys the paper along the paper transportation path. The carriage 11 is disposed in the middle of the paper transportation path of the transportation mechanism 10 and can move freely bidirectionally perpendicularly to the direction of paper transportation. The print head is mounted below the bottom of the carriage 11 and discharges fine droplets of ink to the recording paper. The ink cartridges 12 store the ink that is supplied to the print head for printing.

The carriage 11 is supported to move freely widthwise to the paper on a carriage shaft 13 that extends widthwise to the paper, and is affixed to a timing belt 15 that is driven by the carriage motor 14 shown in FIG. 2. The carriage 11 moves bidirectionally widthwise to the paper in conjunction with driving the timing belt 15.

In this inkjet printer 1 the direction in which the recording paper is conveyed is the subscanning direction, the direction in which the carriage 11 moves is the main scanning direction, and text and images can be recorded (printed) by controlling ink discharge from the print head mounted on the carriage 11.

FIG. 3 shows the relationship between the cartridge holder 16 that is connected to the carriage 11 and the ink cartridge 12. The cartridge holder 16 is a case shaped specifically to hold the ink cartridge 12. The cartridge holder 16 has a cavity 17 into which the ink cartridge 12 can be inserted, and an ink supply tube (ink supply nozzle) 18 projecting from one wall forming this cavity 17. A terminal T for reading an electric signal denoting the remaining ink volume, for example, from the ink cartridge 12 is rendered on another wall of the cavity 17.

A pressurized air supply pipe 19 that connects to the pressurized air supply tube of the ink cartridge 12 is also disposed near the ink supply tube 18. An ink absorbing material (such as a synthetic sponge) 20 for absorbing ink is also disposed in a specific area covering the base of the ink supply tube 18 and the surrounding area. This ink absorbing material 20 is a block of a specific shape and is embedded in the foregoing one wall of the cartridge holder 16 so that only one side is exposed to the cavity 17.

FIG. 4 shows the front of the cartridge holder 16. An ink cover 8 that is opened in order to install or remove an ink cartridge 12 is attached to the cartridge holder 16.

A rotary shaft 31 is supported by two support holes formed in the printer case not shown at the front opening to the cartridge holder 16. The ink cover 8 is supported on this rotary shaft 31 so that the ink cover 8 can swing to open the front opening to the cartridge holder 16 as indicated by the solid lines in FIG. 4, or close the cartridge holder 16 as indicated by the broken line in FIG. 4.

A plurality of operating levers 32 corresponding to the plurality of cartridge holders 16 is located inside the ink cover 8 when the ink cover 8 is closed. An engagement hole 33 is formed in the base part of each operating lever 32. A support rod not shown passes through the engagement hole 33 in each operating lever 32 and thus pivotally supports each operating lever 32.

Rotating the operating lever 32 in the same direction as the direction in which the ink cover 8 opens when the ink cover 8 is open enables the ink cartridge 12 to be installed or removed.

More specifically, when an ink cartridge 12 is loaded into the cartridge holder 16, the operating lever 32 is rotated in the same direction as the direction in which the ink cover 8 opens. The ink cartridge 12 is then inserted to the cartridge holder 16, thus causing the operating lever 32 to arise.

This causes the pushing portion 34 of the operating lever 32 to contact the front end of the ink cartridge 12, and the ink cartridge 12 is installed in the cartridge holder 16 using the lever principle.

To remove an ink cartridge 12 from the cartridge holder 16, the operating lever 32 is again rotated in the same direction as the direction in which the ink cover 8 opens, thereby pushing the ink cartridge 12 out by means of an intervening link rod not shown that engages part of the operating lever 32.

The ink cartridge 12 is thus pushed forward into the opening and can be easily removed.

A switch 35 for detecting opening the ink cover 8 is also attached to the cartridge holder 16. The switch 35 touches the back of the ink cover 8 and goes on when the ink cover 8 closes, and turns off when the ink cover 8 opens. A tactile switch is used for switch 35 in this aspect of the invention.

When the switch 35 is off, the pressure adjustment valve 47 (FIG. 5) is opened unconditionally by the CPU 80 (FIG. 7). This releases the pressurized air applied by the pressure pump to each ink cartridge 12 into the atmosphere when the ink cover 8 is opened to replace an ink cartridge 12. Note that this embodiment is described as using a pressure pump, but the invention shall not be so limited and a means other than a pump can be used to pressurize the ink supply path.

A inkjet printer 1 according to this aspect of the invention uses black ink and color ink, specifically magenta, cyan, and yellow ink. FIG. 5 shows the ink supply paths for these different colors of ink.

In the embodiment shown in FIG. 5, the ink cartridges 12 corresponding to these different colors of ink are black ink cartridges 42 and 43, and color ink cartridges 44, 45, 46 for magenta, yellow, and cyan, respectively. In the ink supply path map shown in FIG. 5, air compressed by pressure pump 41 is supplied to black ink cartridges 42 and 43 and magenta, yellow, and cyan ink cartridges 44, 45, 46. Ink is supplied from each of these ink cartridges 42 to 46 to the print head 66 by way of corresponding choke valves 48 to 52, tubes 53 to 57, couplings 58 to 61, and self-sealing valves 62 to 65.

The print head 66 discharges ink from nozzles corresponding to each color to print on the recording paper. Symbols S in FIG. 5 denote pressure sensors for detecting the air pressure supplied from the pressure pump 41 to each of the ink cartridges 42 to 46. The pressure pump 41 is driven to apply the appropriate pressure based on the pressure detected by these sensors.

FIG. 6 is an oblique view showing the ink cartridge 12. An ink suction opening 51 to which the ink supply tube 18 of the cartridge holder 16 is inserted, and a pressurized air inlet tube 52 that connects to the pressurized air supply pipe 19 for introducing pressurized air to the ink cartridge, are formed on one end of the ink cartridge 12.

A circuit board 54 is affixed to the side at one end of the ink cartridge 12. Electric signal terminal 55 is rendered on one side of this circuit board 54, and an IC chip (not shown in the figure) that is electrically connected to the electric signal terminal 55 is rendered on the other side of the circuit board 54. The IC chip includes nonvolatile memory for storing data such as the remaining ink volume. Electric signal terminal 55 connects with the electric signal terminal T of the cartridge holder 16 to exchange signals between the IC chip and the CPU 80 of the inkjet printer 1.

FIG. 7 is a block diagram of the ink volume calculating device for detecting ink leakage based on the time from when the ink cover 8 opens until the ink cartridge 12 is removed from the cartridge holder 16. This ink volume calculating device is composed of the above-noted switch 35, pressure adjustment valve 47, and a LED 81 connected to a CPU 80, for example, as the operating unit. This switch 35 is the ink cover 8 opening/closing detection switch, and the pressure adjustment valve 47 is a solenoid that opens and closes the output pressure of the pressure pump 41 to the air.

Opening the ink cover 8 to replace an ink cartridge 12 also operates the switch 35 of this ink volume calculating device, and this operation of the switch 35 causes the CPU 80 to open the pressure adjustment valve 47. Air pressurized by the pressure pump 41 is thus released into the atmosphere, and the pressure starts to drop.

This causes the pressure inside the ink cartridge 12 to drop, relieves the pressure pushing ink from the ink cartridge 12 to the print head, and leaves some ink in the ink path.

When the ink cartridge 12 is removed from the cartridge holder 16, the ink that is left in the ink path and was not used for printing is free to leak from the ink cartridge connection. How much ink leaks is known from experimental or calculated values, and changes over time as shown by the curve in FIG. 8. Ink leakage can therefore be conversely accurately determined based on time.

More specifically, ink leakage decreases according to how much time passes from when the ink cover 8 opens (ink pressure is released) until the ink cartridge 12 is removed. Note that the curve shown in FIG. 8 will vary somewhat according to the shape of the ink supply tube 18 and the size of the cartridge holder 16, for example.

As described above, the CPU 80 measures the time from when the ink cover opens until the ink cartridge 12 is removed from the cartridge holder 16, refers to the curve shown in FIG. 8, and can thus accurately detect ink leakage based on this time.

Furthermore, the CPU 80 can also calculate the total ink leakage from these detected ink leakage values, and based thereon can prompt the user to replace the ink absorbing material 20 by turning on LED 81 or audio output.

An inkjet recording apparatus according to the present invention can thus prompt the user to prepare and replace the ink absorbing material 20 with one of sufficient thickness and ink absorption capacity by detecting how much ink will leak based on the time between when the ink cover 8 is opened and the ink cartridge 12 is removed from the cartridge holder 16, and can thus prevent ink from soiling the cartridge holder.

This embodiment of the present invention has been described as detecting ink leakage based on the time required to remove the ink cartridge from the cartridge holder. However, ink leakage can alternatively be detected based on the change in pressure in the ink path on the ink cartridge side or the cartridge holder side during the time required to remove the ink cartridge from the cartridge holder.

APPLICATION IN INDUSTRY

The present invention measures ink leakage and based on this measurement prompts the user to replace the ink absorbing material, thus avoiding using the ink absorbing material beyond the ink absorption capacity of the material, and thereby effectively prevents the user from getting dirty hands as a result of replacing the cartridge holder or ink cartridge. The present invention can thus be advantageously used in inkjet recording apparatuses that determine how much ink remains in the ink supply path when the ink cover covering the ink cartridge is opened, as well as in facsimile machines, photocopiers, and hybrid devices incorporating such an inkjet recording apparatus.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An inkjet recording apparatus comprising:

a control unit;

a cartridge holder for housing a removable ink cartridge, said cartridge holder having an ink cover for selectively opening and closing said cartridge holder for removing and inserting said ink cartridge, said cartridge holder being further effective for maintaining a housed ink cartridge in a pressurized state when said ink cover is closed; and a recording head connected to the cartridge holder for discharging ink based on printing control data to form an image on a recording medium using ink supplied from the housed ink cartridge in a pressurized state;

wherein ink pressure to the housed ink cartridge is relieved when said ink cover is opened, and ink leakage from the ink cartridge during its removal from the cartridge holder is absorbed by an ink absorbing material disposed on the cartridge holder; and wherein said control unit tracks a cartridge removal time from when the ink cover is opened till the ink cartridge is removed from the cartridge holder, and based on this cartridge removal time, obtains a measure of the amount of ink leakage from the ink cartridge and ink cartridge communicating tube during its removal from the cartridge holder.

2. An ink management method for an inkjet recording apparatus having a cartridge holder for housing a removable ink cartridge, said cartridge holder having an ink cover, a recording head and an ink absorbing material, wherein the ink cover is effective for selectively opening and closing said cartridge holder for removing and inserting said ink cartridge, said recording head is effective for discharging ink based on printing control data to form an image on a recording medium using ink supplied from the ink cartridge, and said ink absorbing material is effective for absorbing ink leakage from said ink cartridge and ink cartridge communicating tube during its removal from the cartridge holder after the ink cover is opened, which causes ink pressure to the ink cartridge to be relieved, said method comprising: indirectly monitoring the ink absorbed by the ink absorbing material by tracking how much time elapses from when the ink cover is opened till the ink cartridge is removed from the cartridge holder.

* * * * *